United States Patent [19]

Thomas

[11] 4,407,181

[45] Oct. 4, 1983

[54] PROCESS FOR IMPROVING THE TONAL QUALITY OF STRINGED INSTRUMENTS

[76] Inventor: Thomas H. Thomas, R.F.D. #2 Box 19, Litchfield, Me. 04350

[21] Appl. No.: 224,114

[22] Filed: Jan. 12, 1981

[51] Int. Cl.[3] ..... G10D 1/02; G10D 3/02

[52] U.S. Cl. ..... 84/275; 84/192; 84/291; 144/329; 144/359; 144/363

[58] Field of Search ..... 84/275, 277, 291, 309; 144/329, 359, 363

[56] References Cited

U.S. PATENT DOCUMENTS

| | | | |
|---|---|---|---|
| 208,017 | 9/1878 | Jacobus | 84/275 |
| 322,925 | 7/1885 | Hall . | |
| 358,542 | 3/1887 | Chew . | |
| 1,382,310 | 6/1921 | Neilly . | |
| 1,384,492 | 7/1921 | Sivard . | |
| 1,413,916 | 4/1922 | Kincannon . | |
| 1,635,502 | 7/1927 | Redlinger . | |
| 1,802,250 | 4/1931 | Gruppe . | |
| 1,941,595 | 1/1934 | Burdick . | |
| 3,084,586 | 4/1963 | Westlake | 84/275 |
| 3,884,109 | 5/1975 | Johnson | 84/275 |

OTHER PUBLICATIONS

Hutchins: "The Acoustics of Violin Plates", Scientific American, vol. 245, No. 4, Oct. 1981, pp. 170 et seq.

*Primary Examiner*—Lawrence R. Franklin
*Attorney, Agent, or Firm*—Kenway & Jenney

[57] ABSTRACT

To improve the tone quality of a stringed instrument which includes a wooden sounding board, a bridge resting upon the sounding board and supporting strings, one repeatedly removes small increments of wood from the sounding board in an area where the bridge meets the sounding board.

2 Claims, 5 Drawing Figures

PROCESS FOR IMPROVING THE TONAL QUALITY OF STRINGED INSTRUMENTS

BACKGROUND OF THE INVENTION

As an amateur cellist and pianist I have for many years been dissatisfied with the tonal quality of such instruments and have conducted a great many experiments in an effort to find a treatment which would greatly improve the quality of the timbre of musical instruments in which strings pass over a bridge member which in turn rests upon a sounding board of wood. Such instruments include the piano, violin family, guitar, etc.

What distinguishes the sound of one type of instruments from another is the mix of harmonics. In stringed instruments, that mix, in modern instruments, is characterized by an excessively large number of the higher harmonics. The result is to impart shrillness and dissonance to the sound. My invention relates to a process of treating such instruments to reduce the content of the higher harmonics and thereby produce a more sonorous, richer timbre.

Wood is not homogeneous as to density, flexibility and other physical characteristics. The nature of each piece of wood depends upon many factors including the chemical nature of the soil in which its tree grew, the climatic conditions experienced by the tree, and perhaps even the composition of the air in which the tree grew. Hence it is not possible to prescribe a definite thickness for the spruce in the belly or back of a member of the violin family or for the sounding board of a piano. One cannot predict the tone quality produced. That accounts for the well-known fact that instruments of identical design produced by the same craftsmen will differ widely in quality.

SUMMARY OF THE INVENTION

I have discovered that the tone of stringed instruments can be greatly improved by reducing the thickness of the sounding board in an area disposed beneath the foot of the bridge. In practicing the process upon a member of the violin family I first unstring the instrument, removing the bridge. Then I scrape a few thousandths of an inch off the belly in the area where the feet of the bridge rest. The instrument is then re-strung, and played. The quality of the tone will be somewhat improved. The process is then repeated until the quality of the tone is reasonably satisfactory. If the process is carried too far the quality will be ruined. When to stop repeating the process is something only experience can determine, but it is not difficult for someone with an ear for music. Since wood is not homogeneous, one cannot prescribe dimensions which would apply to all instruments.

After the foregoing process has been carried out, the timbre can be further improved by similar treatment involving reducing the thickness of the back of the instrument in the area where the bottom of the sound post rests upon the inside surface of the back of the instrument. It is important that the work on the belly be completed prior to any work on the back. The reduction of the thickness of the back further improves the tonal quality of the instrument.

In the case of a piano tonal quality can be improved by reducing the thickness of the sounding board by repeatedly scraping the lower surface in areas underlying the bridges. Similarly a guitar may be treated by scraping the interior surface of the belly, using a scraper inserted through the sound hole.

Those skilled in the art will of course understand that I am speaking of conventional modern instruments constructed of wood. The bellies and backs of such instruments are normally of uniform thickness in any given area.

BRIEF DESCRIPTION OF THE DRAWINGS

The objects and features of my invention will be more readily understood and appreciated from the following detailed description of preferred embodiments of the invention as shown in the accompanying drawings, in which.

DESCRIPTION OF THE PREFERRED EMBODIMENT

Figure 1:
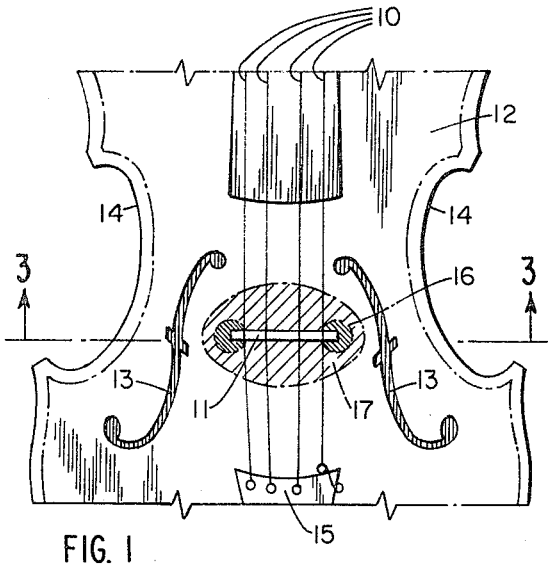
FIG. 1 is a plan view of a portion of an instrument of the violin family.
Figure 3:
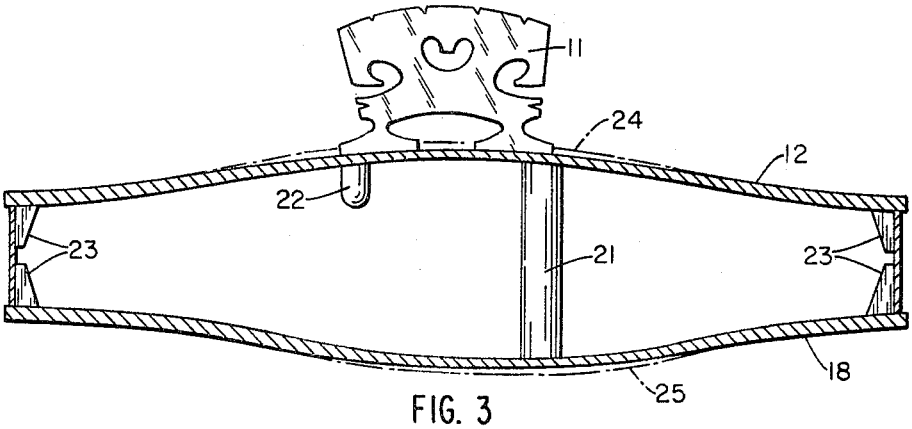
FIG. 3 is a view in cross-section along the line 3—3 of FIG. 1.

It does not appear necessary to describe in detail the violin shown in the drawings, since those skilled in the art are completely familiar with the general technology involved. A complete description is to be found in "Musical Engineering" by Harry F. Olson published by the McGraw-Hill Book Company, Inc. in 1952, particularly with respect to the description beginning at page 118. As shown in FIG. 1 the essential elements of the violin include four strings 10 in which the sound is generated as the strings vibrate under the action of a bow or plucking by the artist. The body of the violin includes a belly 12 which acts as a sound board modifying and amplifying the sound produced by the strings. The belly is provided with a pair of "F" holes 13, center bouts 14 and a tail piece, a portion of which is shown at 15. The tail piece is connected to the lower end of the four strings 10. Positioned on the belly 12 is a bridge 11 over which the strings are stretched. In accordance with the invention the area directly beneath the feet of the bridge 11 is reduced in thickness. Ordinarily the thickness of the belly is at least 8/64". As previously explained the process involves scraping the areas 16 beneath the feet of the bridge 11 in successive steps in each of which a few thousandths of an inch of the wood is removed, the process being carried out in repeated steps until the sound of the instrument is reasonably satisfactory. When that process has been completed, a larger area 17 is scraped and smoothed as shown in FIG. 1. FIG. 3 shows at 24 the original thickness of the belly prior to the reducing operation. The reduction in the area 17 is carried out in order to produce a gradual smooth appearance.

Figure 4:
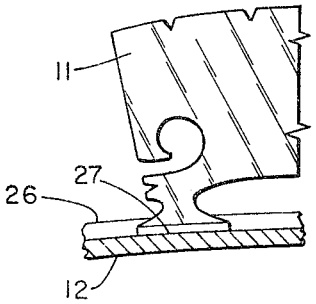
FIG. 4 is a view partly in cross-section of one foot of the bridge and its relation to the belly of the instrument.

In FIG. 3 there is shown a sound post 21 which transmits the vibrations of the belly to the back 18 of the instrument. Also in that figure is shown the bass bar 22 and the corner blocks 23. In FIG. 4 there is a partial view of the bridge 11. In that figure the line 27 indicates the reduced thickness of the belly in the location of the bridge feet and line 26 represents the original thickness of the belly 12 prior to the start of the process.

Figure 2:
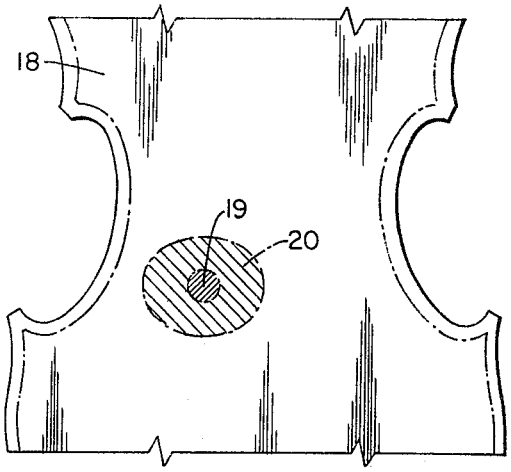
FIG. 2 is a bottom plan view, partly in cross-section, of the back of the instrument, the section being taken along the line 2—2 of FIG. 3.

Once the belly has been satisfactorily treated, the instrument is turned over and a similar process carried out on the back 18 directly beneath the position where the sound post 21 rests on the inside of the belly 18. In FIG. 2 the initially reduced area is shown in cross-hatching at 19 and at 20 there appears the enlarged reduced area again not necessary to the improvement of the tone quality but rather as a means of restoring the smooth, attractive appearance. In actual practice the areas 17 and 20 may well be considerably larger than as shown in FIGS. 1 and 2. In general it can be said that the enlarged area 20 of the back and the similar enlarged area 17 on the belly are not technically required in order to obtain the improvement sought but are rather for esthetic purposes. In FIG. 3 the dotted line 25 shows the original thickness of the portion of the back that has been reduced in accordance with the practice of the invention. At page 217 of "Musical Engineering" appears spectra of the fundamental and harmonics of each of the four strings of a violin vibrating at their open or unstopped condition. These spectra are of course typical and do vary from instrument to instrument. As the result of the process of my invention it will be found that the amplitude of the higher harmonics has been reduced, thus reducing the shrillness and producing a more mellifluous tone.

To recapitulate, by judicious, minute removals of wood in the area beneath the feet of the bridge, the overtone pattern of the instrument is, bit by bit, lowered until the ideal violin (or other instrument) timbre is achieved. This process is done on the completed instrument prior to finishing. Subsequent smoothing and evening of the surface and finishing will not alter the tone as far as the human ear can perceive. For the artisan to expertly perform this process, a good ear for musical tone and a modest ability to play the instrument are all that are required; abilities of an order to be found in any competent piano tuner for example.

This same process is applicable to the other stringed instruments such as, viola, violincello, double bass, harp and guitar.

Figure 5:
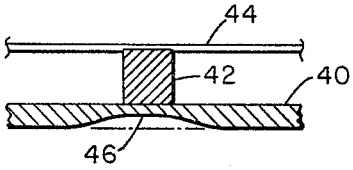
FIG. 5 is a view in cross-section of a portion of the soundingboard-bridge of a piano.

In the piano, as shown in FIG. 5, there is an extensive sounding board 40 on which rest a bass bridge and an upper bridge. In the drawing one of the bridges 42 is shown as well as a portion of a string 44. The function of a soundboard is explained in the previously referred to "Musical Engineering" at page 110.

Obviously it would be a massive task to unstring a piano in order to remove the bridges and scrape the top of the soundboard 40. I have found, however, that the tonal quality of a piano can be markedly improved by repeatedly scraping the bottom of the sound board in the areas beneath the bridges, as shown by the dotted line 46. As with other stringed instruments the scraping is repeated until the desired improvement is achieved. In the case of the piano the tone of all notes is improved. In addition to reducing shrillness, particularly in the higher notes, the lower bass notes become cleaner, deeper, louder and sweeter.

In the case of a guitar it is preferable to scrape the under surface of the belly under the bridge by reaching in through the sound hole with a scraper having a suitably long handle.

It should be clear that the instrument must be played between adjustments and frequently enough not to pass the point of optimum timbre. There is, of course, a range of timbres that are esthetically pleasing and one's taste will govern one's choice. For example, the tone of a Stradivarius is usually described as sweeter but less brilliant than that of a Guanerius del Jesu violin. Both instruments, of course, have their vigorous protaganists.

It is not possible to predict in advance the eventual thickness of the belly when the instrument is judged to have achieved the most desirable tone. Since the instruments are made of wood (a living substance at one time), each belly is different than every other. A useful guideline might be that the wood in the critical area, beneath the feet of the bridge be at least 8/64" in thickness at the beginning of the process. The final thickness may be as little as 4/64" a reduction in thickness of 50%. The larger instruments such as cello, etc. are correspondingly thicker to begin with. The features of this invention may be illustrated by the following examples.

EXAMPLE 1

One begins with a standard, good quality commercial violin in the white (unvarnished). The thickness of the belly under the feet of the bridge is usually at least 8/64". The instrument is strung. A bridge and soundpost are fitted. The instrument tuned and played. The sound will be varying degrees of harsh, thin and nasal. The better the sound, the less work to be done. The area reduced will be about $\frac{3}{8}'' \times \frac{3}{4}''$.

The bridge and strings are removed; a wood scraper (or other appropriate tool) is used to remove a few thousandths of an inch of wood in the area of the feet of the bridge. The instrument is restrung, retuned, etc., and played again. The discerning ear will notice an improvement. The sound will change only slightly with each operation but that is as it should be. Like any other skill, this one improves rapidly with practice but it certainly is not difficult to master, only tedious. Experience dictates when the process is completed. At this point the critical area is marked in some way, the remainder of the belly is reduced in thickness and shaped to elininate any uneveness or hollows. The instrument can now safely be sanded and readied for varnishing. The last processes will not effect the tone at all if the critical area is not changed in any way. When the foregoing work has been completed a similar process is carried out on the back beneath the soundpost.

EXAMPLE 2

In making a cello one obtains a good quality white commercial instrument. The belly should be at least 16/64" or $\frac{1}{4}''$ in thickness under the bridge. As in Example 1 the bridge and soundpost are fitted, the instrument strung, tuned and played. As on the violin the sound will usually be quite nasal and weak but not so harsh as a violin because of the lower register of the cello.

Again, the bridge and strings are removed. A wood scraper is used to remove a few thousandths of an inch of wood in the area immediately beneath where the feet of the bridge would set. The instrument is restrung and retuned and replayed. Note is made of the lowered improved tone and the process is repeated as often as necessary by very small degrees with frequent replaying until the beauteous, sonorous timbre of the instrument has been created. Again, the critical area is marked. The remainder of the belly is adjusted to eliminate any hollows, dents, etc., to, in fact, make undetectable what has been done to the instrument. Finishing can now proceed with full confidence that the tone will be unaltered from the moment of the last minute scraping. When the foregoing work has been completed a similar process is carried out on the back beneath the soundpost.

What I claim as new and desire to secure by Letters Patent of the United States is:

1. A process of improving the tonal quality of any commercially made completed stringed instrument, such as, a violin or cello with an adequately thick belly which comprises the steps of:

1. playing the instrument;
2. removing the bridge and strings of the instrument;
3. reducing the thickness of the belly directly under the feet of the bridge on the outer surface at the belly by a few thousandths of an inch;
4. putting the bridge back on the instrument and re-stringing, retuning, and replaying the instrument;
5. repeating steps 2–4 as many times as necessary until the tonal quality of the instrument is at its optimum; and
6. shaving down surrounding portions of the belly in such a manner as to preserve its smoothly convex, curved surface.

2. A process of improving the tonal quality of any commercially made completed stringed instrument, such as, a violin or cello with an adequately thick belly which comprises the steps of:

1. playing the instrument;
2. removing the bridge and strings of the instrument;
3. reducing the thickness of the belly directly under the feet of the bridge on the outer surface at the belly by a few thousandths of an inch;
4. putting the bridge back on the instrument and re-stringing, retuning, and replaying the instrument;
5. repeating steps 2-4 as many times as necessary until the tonal quality of the instrument is at its optimum;
6. shaving down surrounding portions of the belly in such a manner as to preserve its smoothly convex, curved surface; and
7. thereafter reducing the thickness of the back directly under the base of the sound post by removing material from the outer surface of the back until the desired tonal quality is achieved.

* * * * *